United States Patent [19]

Ignjatic

[11] 4,375,827

[45] Mar. 8, 1983

[54] WORKBENCH TABLE TOP CLAMPING DEVICE

[76] Inventor: Ranko Ignjatic, 68 Arnold Dr., Nepean, Ontario, Canada, K2H 6W3

[21] Appl. No.: 212,571

[22] Filed: Dec. 3, 1980

[51] Int. Cl.[3] ..... B25H 1/00

[52] U.S. Cl. ..... 144/286 R; 269/253

[58] Field of Search ..... 794/285, 286 R, 286 A, 794/287; 269/901, 253

[56] References Cited

U.S. PATENT DOCUMENTS

| | | | |
|---|---|---|---|
| 1,508,979 | 9/1924 | Keller | 144/286 R |
| 1,574,528 | 2/1926 | Youngman et al. | 144/286 R |
| 1,673,139 | 6/1928 | Brown | 144/286 R |

FOREIGN PATENT DOCUMENTS

| | | | |
|---|---|---|---|
| 231691 | 6/1963 | Austria | 144/285 |

*Primary Examiner*—W. D. Bray

*Attorney, Agent, or Firm*—Edward E. Pascal

[57] ABSTRACT

An improved workbench table top cut away at a corner to provide a rectangular rabbet, and having an extension arm extending across the corner below the top surface of the table. A U-shaped clamping member includes an elongated arm adjoining outer and inner legs, and is disposed in a plane parallel to the table top around the extension arm. The extension arm includes a hole spaced from its end. A brace bar of similar but slightly smaller dimensional cross-section as the hole joins the legs through the hole. A conventional adjustment means such as a screw is utilized to adjust the clamping member relative to the extension arm along an axis of adjustment. Narrow extensions in the elongated arm are fitted in cooperatively shaped slots in abutting portions of the legs, and pins extend orthogonally through the legs and arm extensions. A first rail extends from the extension arm across the rabbet and is fixed to the opposite side thereof, and is disposed against and in sliding contact with the brace bar. The elongated arm is disposed against and in sliding contact with the end of the extension arm, whereby the clamping member is held in lateral position relative to the table top but is slidable along the axis of movement. The inner leg is also preferably notched. A second rail extends from the extension arm across the rabbet to the opposite side thereof. The first rail is preferably fixed to and runs parallel to the lower surface of the second rail. The notch in the inner leg is cooperatively shaped to the cross-section of the first and second rails. The surface of the inner leg in the notch bears against and is in sliding contact with the first and second rails in a plane parallel to the plane of sliding contact between the elongated arm and the end of the extension arm. This structure has been found to provide substantially increased resistance to distortion and looseness caused by wear, while assuring smooth operation.

13 Claims, 4 Drawing Figures

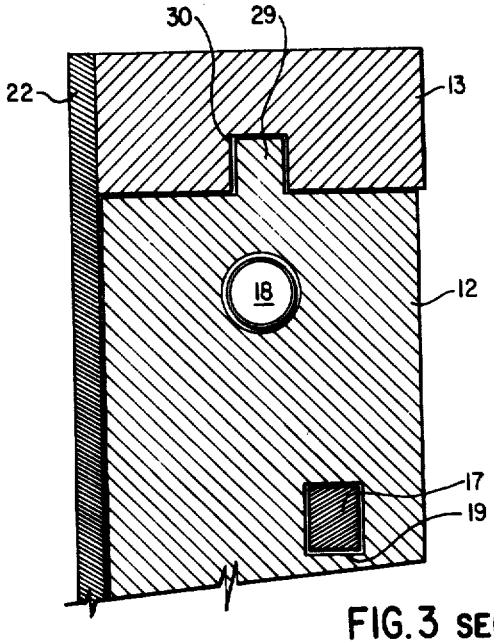
FIG. 3 SECTION J-J
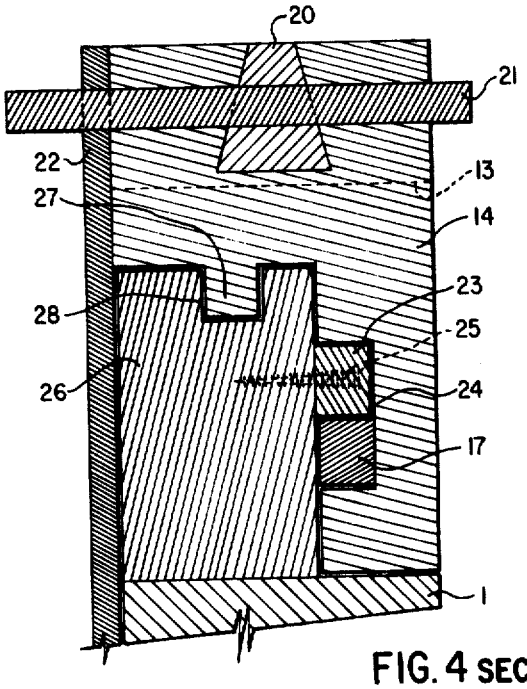
FIG. 4 SECTION K-K

WORKBENCH TABLE TOP CLAMPING DEVICE

This invention relates to workbenches, and particularly to clamping devices for workbenches.

A woodworker's workbench usually incorporates a clamping device such as a vise, which is formed as part of the workbench table top. The clamping device itself, when closed, usually provides a top surface which is coplanar with the remainder of the workbench top surface. However the elements of the clamping device form a structure which is subject to considerable stress when operated; the members are often joined by tongue and groove joints, which are glued together.

While tongue and groove joints have provided reasonable strength for light-duty use, after heavy use or considerable stress, particularly for loads which are not centered on the exact axis of pressure, they are apt to loosen. As a result the elements exerting clamping pressure go out of square, thus reducing the clamping accuracy, providing uneven pressure on a work piece, etc. This can result in a poorly produced product, having impressed damage marks and other imperfections.

A workbench of the type referred to above is described in U.S. Pat. No. 1,508,979 to Peter Keller, issued Sept. 16, 1924. In the workbench described, a rabbet is cut out of a corner, and a clamping member of similar shape as the rabbet slides, by the use of a screw, into and out of the rabbet. A brace rod extends between legs of the clamping member, in order to rigidize the structure.

However, it will be noted that the brace rod merely fits into holes of similar cross-section in the legs of the clamping member, and is glued therein. The brace rod slides within a guide hole in the side of the workbench. The screw is rotatably fixed in an arm extending across the end of the rabbet, whereby the clamping member can be moved.

Upon the exertion of considerable stress on the clamping member by an operator tightening the screw, particularly when narrow pieces of wood are clamped off the axis of pressure, forces oblique to the axis of pressure are applied to the generally rectangular clamping member, thus stressing and eventually loosening the corner joints.

Further, it will be observed that as the hole in the side of the workbench which accommodates the brace rod wears, as the clamping member is advanced, the clamping member will close having its forward surface in a plane oblique to the plane of the end of the rabbet particularly when clamping narrow pieces of wood. Clearly this is undesirable from the operator's point of view, since parallel facing surfaces of the faces which provide the clamping pressure are essential for accurate woodworking.

The present invention is an improvement to the structure of the workbench, and particularly to the clamping member. An improved joint structure is formed between the major parts of the clamping structure, and a brace bar is utilized which rides against a rail which provides lateral support against distortion of the clamping member, and also locks the clamping member into position. In addition, sliding tongue and groove joints are used which provide additional lateral support to the clamping member, obsorbing sideways directed components of force on the clamping member.

In general, the invention is an improved workbench table top cut away at a corner to provide a rectangular rabbet, and having an extension arm extending across the corner below the top surface of the table. A U-shaped clamping member includes an elongated arm adjoining outer and inner legs, and is disposed in a plane parallel to the table top around the extension arm. The extension arm includes a hole spaced from its end. A brace bar of similar but slightly smaller dimensional cross-section as the hole joins the legs through the hole. A conventional adjustment means such as a screw is utilized to adjust the clamping member relative to the extension arm along an axis of adjustment. In the improvement, narrow extensions to the elongated arm are fitted into cooperatively shaped slots in abutting portions of the legs, and pins extend orthogonally through the legs and arm extensions.

Preferably, the pin which is inward of the rabbet extends higher than the table, whereby it can be used to bear against a workpiece which is also clamped against a similar pin extending into the table top farther along the axis of movement of the clamping member.

According to a preferred embodiment of the invention, a first rail extends from the extension arm across the rabbet and is fixed to the opposite side thereof, and is disposed against and in sliding contact with the brace bar. The elongated arm is disposed against and in sliding contact with the end of the extension arm, whereby the clamping member is held in lateral position relative to the table top but is slidable along the axis of movement.

The inner leg is also preferably notched. A second rail extends from the extension arm across the rabbet to the opposite side thereof. The first rail is preferably fixed to and runs parallel to the lower surface of the second rail. The notch in the inner leg is cooperatively shaped to the cross-section of the first and second rails. The surface of the inner leg in the notch bears against and is in sliding contact with the first and second rails in a plane parallel to the plane of sliding contact between the elongated arm and the end of the extension arm.

The clamping member portion of the table top described above has been found to provide substantially increased resistance to distortion and looseness caused by wear, while assuring smooth operation.

A better understanding the invention will be obtained by reference to the description below with reference to the following drawings, in which:

FIG. 3 is a sectional view of the invention along section J—J of FIG. 2, and FIG. 4 is a sectional view of the invention along section K—K of FIG. 2.

Figure 1:
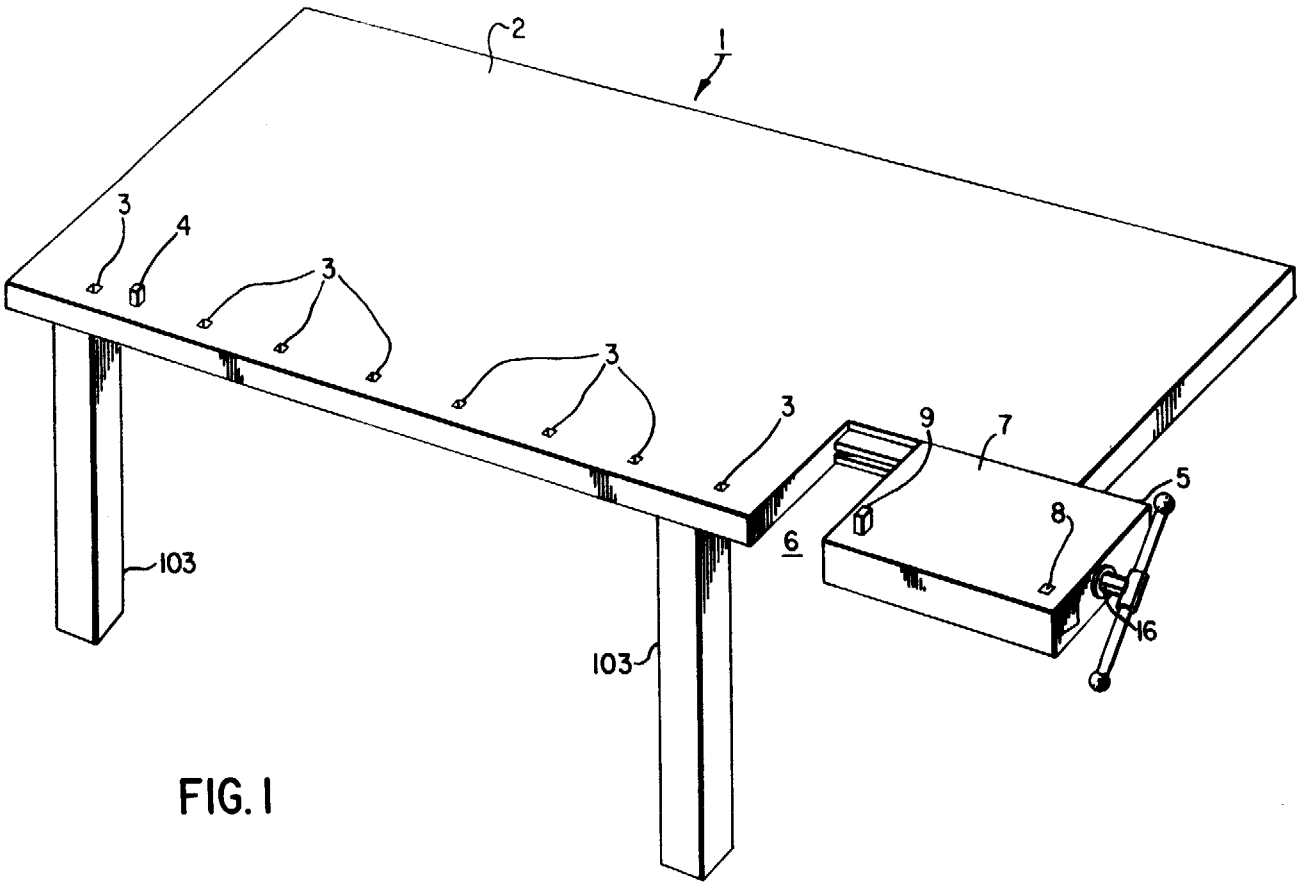
FIG. 1 is a perspective of a workbench which utilizes a clamping member according to the invention.

Turning first to FIG. 1, a workbench is generally shown as reference 1, comprised of a table top 2 and supporting legs 103. The particular manner of supporting the workbench is conventional and does not form part of this invention.

The table top 2 contains a plurality of holes 3 all in line, typically of rectangular cross-section (but not restricted thereto) within which a cooperatively shaped pin 4 is removably wedged.

A clamping member 5, the position which is adjustable by screw 6, can move inwardly and outwardly of a rabbet 6 which is cut out of the table top 2. An upper surface 7 of the clamping member 5 is in the same plane as the upper surface of the table top.

The clamping member 5 contains a pair of holes 8, within which pins 9 are removably wedged (only one pin being shown for the sake of illustration).

In operation, the screw 16 is rotated to move the clamping member out of the rabbet, in order that a workpiece can be inserted between the opposing faces of the edge of the table top within the rabbet 6 and the clamping member 5. The screw is then turned to close the clamping member, whereby the workpiece can be securely retained.

Alternatively, a long workpiece can be wedged between the pins 4 and 9, the screw 16 being turned to move the clamping member into the rabbet and clamp the workpiece in place. Pin 4 can be inserted alternatively in any of the holes 3, and pin 9 can extend upwardly from any of the holes 8.

It may be seen that the optimum axis along which holes 3 and 8 are located may not be along the exact pressure axis of clamping member 5. As screw 16 is tightened, a lateral component of force is exerted on clamping member 5, which, with high force and wear, has in the past weakened the joints of the parts of the clamping member, loosening them and distorting the clamping member. Narrow workpiece held vertically between the clamping member and the facing edge of the workbench, would accelerate the effect.

Figure 2:
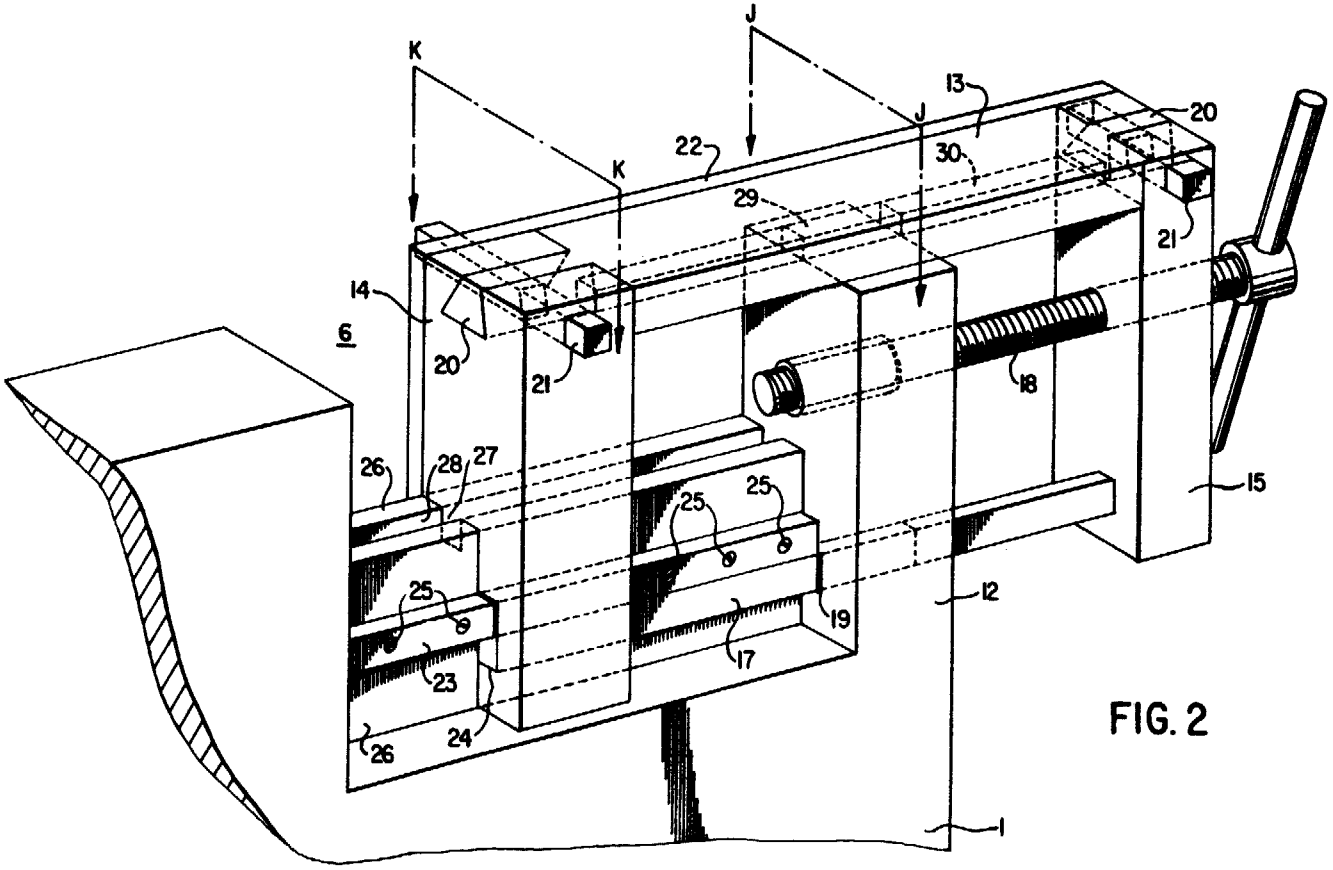
FIG. 2 is a perspective view, partly in phantom, from underneath the table top, showing the elements of the invention.

Turning now to FIGS. 2, 3 and 4, the structure of the present invention is shown. FIG. 2 is a view from the underside of the workbench at the corner which contains the clamping member. FIGS. 3 and 4 are sectional views of sections J—J and K—K respectively, of FIG. 2.

The workbench 1 has an extension arm 12 extending across the end of the rabbet 6 which, as described earlier, is cut out from one corner of the workbench. A U-shaped clamping member is comprised of an elongated arm 13, joined to an inner leg 14 and an outer leg 15, which extends transverse to the elongated arm 12 in a plane parallel to the table top.

The extension arm 12 contains a hole 19, through which extends a brace bar 17, of similar but slightly smaller dimensional cross-section as hole 19. The brace bar 17 joins the legs 14 and 15 through the hole. A screw 18, rotatably held in extension arm 12 and threaded into outer leg 15 in a conventional manner, causes the clamping member comprising elongated arm 13 with inner and outer legs 14 and 15 to move relative to extension arm 12 in a conventional manner.

The joints between elongated arm 13 and legs 14 and 15 would ordinarily be joined as in the aforenoted U.S. Pat. No. 1,508,979 and glued but would be subject to loosening and distortion under stress having a component along a diagonal vector. However according to the present invention, narrow extensions 20 of elongated arm 13 are fitted into cooperatively shaped slots in abutting portions of legs 14 and 15. Pins 21 extend through holes of similar cross-section which pass through both the legs 14 and 15 and extensions 20. The joints, except for pins 21 (unless desired) are glued as usual. Preferably the extensions are prism shaped, their inner surfaces relative to the legs being broader than their outer surfaces.

The advantages of the extensions 20 fitting into cooperatively shaped slots in the legs are that they provide a relatively broad flat surface against the legs in the vertical direction, (with reference to the view shown in FIG. 2), while the flat surface of the end of the elongated arm bearing against the abutted surface of legs 14 and 15 provide support against stress in the horizontal direction (relative to the same view).

In addition, pins 21 passing through the legs and extension members, retain the surfaces just described in intimate contact; this causes increased resistance to rocking of the joint and increased wear. As a result the joints between the elongated arm 13 and inner and outer legs 14 and 15 are maintained with substantially increased resistance to distortion over woodworking workbench clamping members of the prior art.

A table section member 22 having similar plane surface shape as the rabbet overlies and is joined to the elongated arm and legs, and also overlies the extension arm. The upper surface of the table section is in the same plane as the surface of the table top, the lateral edges of the table section being located along opposite edges of inner and outer legs 14 and 15, and the outer edge of the table section 22 being located along a third edge of the elongated arm 13.

Preferably at least one of the pins 21 is removable and can be extended above the upper surface of the table section member in order that it can be used as a clamp against a workpiece lying on the table top, as described with reference to FIG. 1. The extending pin corresponds to pin 9 of FIG. 1.

In order to provide increased strength of the clamping member against wobbling or movement in a non parallel plane relative to the workbench either under stress or after release from stress, a first rail 23 extends from the extension arm 12 to which it is fixed to the opposite side of the rabbet. The first rail 23 is disposed against, and is in sliding contact with the brace bar 17. Preferably brace bar 17 is held to inner leg 14 in a channel or notch 24 which is cut in the leg 14. Brace bar 17 is glued and preferably screwed to inner leg 14 in notch 24, while rail 23 is in sliding contact therewith. It should be noted that rail 23 is screwed by means of screws 25 to a supporting surface, since it keys the assembly together (to be described later). Rail 23 is in sliding contact with brace bar 17 and inner leg 14 within notch 24. By this structure the clamping member is held in lateral position relative to the table top, but is slidable along the axis of movement.

A second rail 26 extends from and is fixed to the extension arm 12 across the rabbet to the opposite side thereof, and supports first rail 23 at its side, rail 23 being screwed thereto. A preferably rectangularly shaped tongue 27 of a cut-out or notch in inner leg 14 extends into a groove 28 which runs from one end to the other of the second rail 26. The inner leg 14 is cooperatively shaped to the top and side surfaces of second rail 26.

The end of extension arm 12 is also shaped into a tongue 29, preferably having a rectangular cross-section, which fits into a cooperatively shaped groove 30 in the abutting surface of elongated arm 13. The remaining surface of the end of extension arm 12 is preferably flat, but should be of cooperative shape with the adjacent and abutting surface of elongated arm 13, in order to facilitate sliding contact therewith.

In operation, it may be seen that with rotation of screw 18, stress is exerted on outer leg 15 which is transferred to elongated arm 13, inner leg 14, table section 22 and brace bar 17. As a result, the assembly, which forms the clamping member, is moved within the rabbet 6, inner leg 14 moving relative to extension arm 12.

Brace bar 17 slides within hole 19 of extension arm 12. However it also bears against rail 23, thus supporting it against upwardly directed forces, (relative to the view of FIG. 2).

At the same time, leg 14 slides and bears against the abutting surface of second rail 26, while the end of extension arm 12 bears and slides against the abutting cooperative surface of elongated arm 13. In addition, the upper surface of rail 23, (relative to the view of FIG. 2) bears against the abutting surface of leg 14. These abutting surfaces support the clamping member against downwardly directed stresses. At the same time, the end surface of extension arm 12, in cooperation with the contacting surfaces between brace bar 17 and first rail 23 absorbs clockwise directed stresses. The upper surface of brace bar 17 bearing against the upper surface of hole 19 in extension arm 12, with the upper surface of rail 23 bearing against the adjacent surface of inner arm 14 absorbs counterclockwise directed forces.

The tongue and groove adjoining surfaces of tongue 27 and groove 28, and tongue 29 and groove 30 absorb stress in the lateral direction, whether unidirectional, or differentially clockwise or counterclockwise. Such forces are also resisted by the surface sliding contact between brace bar 17 and the adjoining surface of second rail 26.

It may be therefore be seen that the clamping member affords substantially increased rigidity against distortion with respect to its own members, and relative to the remainder of the workbench.

To assemble the clamping member relative to the table top, the clamping member is placed into position, without first rail 23. First rail 23 can be made in two coextensive parts. The first part is first screwed into position against second rail 26, following which the clamping member is moved using screw 18 so that the first part of rail 23 is contained within the channel or notch 24. The second portion of first rail 23 is then screwed into position, completing the assembly.

Various alternative embodiments or variations may now be conceived by a person skilled in the art understanding this invention. All such embodiments and variations are considered to be within the sphere and scope of this invention, as defined in the claims appended hereto.

I claim:

1. An improved workbench table top cut away at a corner to provide a rectangular rabbet, an extension arm extending across the corner below the top surface of the table, a U-shaped clamping member having an elongated arm adjoining an outer and an inner leg disposed in a plane parallel to the table top around the extension arm, said extension arm including a hole spaced from its end, a brace bar of similar but slightly smaller dimensional cross-section as said hole joining said legs through said hole, means to adjust the clamping member relative to the extension arm along an axis of adjustment, the elongated arm having narrow extensions which are fitted into cooperatively shaped slots in abutting portions of said legs, and pins extending orthogonally through said legs and arm extensions.

2. A table top as defined in claim 1, further including a table section member having similar plane shape as said rabbet overlying and joined to the elongated arm and legs, and overlying the extension arm, having an upper surface in the same plane as the surface of the table top, the legs being located along opposite edges and the elongated arm being located along a third edge thereof, at least one of said pins being removeable and extendable above the upper surface of the table section member, and further including at least one hole in the table top for retaining a further pin at a location opposite said removeable pin along the axis of movement of the clamping member.

3. A table top as defined in claim 1 or 2 further including a first rail extending from the extension arm across the rabbet to the opposite side thereof, disposed against and in sliding contact with the brace bar, said elongated arm being disposed against and in sliding contact with the end of said extension arm, whereby the clamping member is held in lateral position relative to the table top but is slideable along said axis of movement.

4. A table top as defined in claim 1 or 2 further including a first rail extending from the extension arm across the rabbet to the opposite side thereof, disposed against and in sliding contact with the brace bar, said elongated arm being disposed against and in sliding contact with the end of said extension arm, said inner leg being notched, a second rail extending from the extension arm across the rabbet to the opposite side thereof, the first rail being fixed to and running parallel to the lower surface of the second rail, the notch being cooperatively shaped to the cross-section of the first and second rails, one surface of the inner leg within the notch bearing against and being in sliding contact with the second rail in a plane parallel to the plane of sliding contact between the elongated arm and the end of the extension arm, whereby the clamping member is held in lateral position relative to the table top but is slideable along said axis of adjustment.

5. A table top as defined in claim 1 or 2 further including a first rail extending from the extension arm across the rabbet to the opposite side thereof, disposed against and in sliding contact with the brace bar, said elongated arm being disposed against and in sliding contact with the end of said extension arm, said inner leg being notched, a second rail extending from the extension arm across the rabbet to the opposite side thereof, the first rail being fixed to and running parallel to the lower surface of the second rail, the notch being cooperatively shaped to the cross-section of the first and second rails, one surface of the inner leg within the notch bearing against and being in sliding contact with the second rail in a plane parallel to the plane of sliding contact between the elongated arm and the end of the extension arm; the inner leg with the second rail, and the elongated arm with the end of the extension arm both being respectively tongue and grooved whereby the clamping member is held in lateral position relative to the table top but is slideable along said axis of adjustment.

6. A table top as defined in claim 1, further including a first removeable rail extending from the extension arm across the rabbet to the opposite side thereof, disposed against and in sliding contact with the brace bar, said elongated arm being disposed against and in sliding contact with the end of said extension arm, whereby the clamping member is held in lateral position relative to the table top but is slideable along said axis of adjustment.

7. A table top as defined in claim 6, in which the inner leg is notched, further including a second rail extending from the extension arm across the rabbet to the opposite side thereof, the first rail being fixed and running parallel to the lower surface of the second rail, the notch being cooperatively shaped to the cross-section of the first and second rails, one surface of the inner leg in the notch bearing against and being in sliding contact with the second rail in a plane parallel to the plane of sliding contact between the elongated arm and the end of the extension arm, whereby the clamping member is held in lateral position relative to the table top but is slideable along said axis of adjustment.

8. A table top as defined in claim 7, the inner leg being further notched in the side of the former notch, the further notch having a cross-section in the shape but of slightly larger dimension than the first rail and the brace bar in abutment, one end of the brace bar being fixed to the inner leg within said further notch, and the first rail being in sliding contact with the brace bar and inner leg within said further notch.

9. An improved workbench table top cut away at a corner to provide a rectangular rabbet, an extension arm extending across the corner below the top surface of the table, a U-shaped clamping member having an elongated arm adjoining an outer and an inner leg disposed in a plane parallel to the table top around the extension arm, the extension arm including a hole spaced from its end, a brace bar of similar but slightly smaller dimensional cross-section as said hole joining said legs through said hole, means to adjust the clamping member relative to the extension arm along an axis of movement, a first removeable rail extending from the extension arm across the rabbet to the opposite side thereof, disposed against and in sliding contact with the brace bar, said elongated arm being disposed against and in sliding contact with the end of said extension arm, whereby the clamping member is held in lateral position relative to the table top but is slideable along said axis of movement.

10. A table top as defined in claim 9, in which the inner leg is notched, and further including a second rail extending from the extension arm across the rabbet to the opposite side thereof, the first rail being fixed and running parallel to the lower surface of the second rail, the notch being cooperatively shaped to the cross-section of the first and second rails, one surface of the inner leg in the notch bearing against and being in sliding contact with the second rail in a plane parallel to the plane of sliding contact between the elongated arm and the end of the extension arm, whereby the clamping member is held in lateral position relative to the table top but is slideable along said axis of adjustment.

11. A table top as defined in claim 10, the inner leg being further notched in the side of the former notch, the further notch having a cross-section in the shape but of slightly larger dimension than the first rail and the brace bar in abutment, one end of the brace bar being fixed to the inner leg within said further notch, and the first rail being in sliding contact with the brace bar and inner leg within said further notch.

12. A table top as defined in claim 8 or 11, in which the means to adjust the clamping member is a screw threaded through the outer leg, having one end rotatably held to the extension arm, and having a lateral handle for rotating the screw outside the outer leg.

13. A workbench table top as defined in claim 1, 2 or 6, in which the cross-section of each said extension is prism shaped, having an inner surface which bears against an abutting surface in said slot which is of greater area than its opposite surface.

* * * * *